US009938942B2

(12) United States Patent
Mason et al.

(10) Patent No.: US 9,938,942 B2
(45) Date of Patent: Apr. 10, 2018

(54) FUEL SUPPLY SYSTEM

(71) Applicant: Robert Bosch GmbH, Stuttgart (DE)

(72) Inventors: Paul Mason, Dearborn, MI (US); Hans-Peter Braun, Renfrizhausen (DE)

(73) Assignee: Robert Bosch GmbH, Stuttgart (DE)

( * ) Notice: Subject to any disclaimer, the term of this patent is extended or adjusted under 35 U.S.C. 154(b) by 1038 days.

(21) Appl. No.: 13/900,315

(22) Filed: May 22, 2013

(65) Prior Publication Data

US 2013/0312711 A1 Nov. 28, 2013

Related U.S. Application Data

(60) Provisional application No. 61/650,254, filed on May 22, 2012.

(51) Int. Cl.
*F02M 37/00* (2006.01)
*F02M 37/10* (2006.01)
(Continued)

(52) U.S. Cl.
CPC .... *F02M 37/0047* (2013.01); *F02M 37/0023* (2013.01); *F02M 37/10* (2013.01);
(Continued)

(58) Field of Classification Search
CPC ..... F02M 59/462; F02M 2037/228; F02M 21/0245; F02M 37/0023; F02M 57/026;
(Continued)

(56) References Cited

U.S. PATENT DOCUMENTS 5,195,494 A * 3/1993 Tuckey ..... 123/514
5,642,718 A * 7/1997 Nakai et al. ..... 123/497
(Continued)

FOREIGN PATENT DOCUMENTS

DE 4444854 6/1996
DE 102006059685 6/2008
(Continued)

OTHER PUBLICATIONS

Search Report and Written Opinion for PCT Application No. PCT/IB2013/001519 dated Nov. 26, 2013, 9 pages.
(Continued)

*Primary Examiner* — Marguerite McMahon
*Assistant Examiner* — Tea Holbrook
(74) *Attorney, Agent, or Firm* — Michael Best & Friedrich LLP

(57) ABSTRACT

A fuel supply system includes a fuel pump having a bottom inlet end configured to pick up fuel and a top discharge end configured to discharge fuel at a pressure higher than that of the inlet end. A housing defines a pressure vessel in fluid communication with the discharge end of the fuel pump. The fuel pump is secured with respect to the housing so that the pressure vessel is laterally adjacent the fuel pump and the pressure vessel and the fuel pump have overlapping heights. Exactly one check valve is positioned between the discharge end of the fuel pump and the pressure vessel, and the check valve is spaced laterally away from the discharge end of the fuel pump at an inlet to the pressure vessel.

18 Claims, 4 Drawing Sheets

(51) Int. Cl.
*F02M 37/14* (2006.01)
*F02M 37/22* (2006.01)

(52) U.S. Cl.
CPC ..... *F02M 37/14* (2013.01); *F02M 2037/225* (2013.01); *F02M 2037/226* (2013.01); *F02M 2037/228* (2013.01)

(58) Field of Classification Search
CPC ..... F02M 63/0045; F02M 69/08; F02M 2013/087; F02M 2037/225; F02M 2037/226; F02M 37/0082; F02M 37/025; F02M 37/103; F02M 37/14; F02M 59/365
USPC ..... 123/495, 509, 457, 514, 198 C; 417/423.14, 182.5, 65, 57
See application file for complete search history.

(56) References Cited

U.S. PATENT DOCUMENTS

| | | | | |
|---|---|---|---|---|
| 5,647,329 | A * | 7/1997 | Bucci et al. | 123/509 |
| 5,649,514 | A * | 7/1997 | Okada et al. | 123/514 |
| 6,253,738 | B1 * | 7/2001 | Takahashi et al. | 123/509 |
| 6,435,163 | B1 * | 8/2002 | Fauser et al. | 123/509 |
| 6,640,832 | B2 * | 11/2003 | Walter | 137/565.01 |
| 7,765,990 | B2 * | 8/2010 | Braun et al. | 123/509 |
| 2001/0017128 | A1 * | 8/2001 | Braun et al. | 123/497 |
| 2002/0112700 | A1 * | 8/2002 | Iwamoto et al. | 123/509 |
| 2002/0124833 | A1 * | 9/2002 | Fauser et al. | 123/509 |
| 2003/0127075 | A1 * | 7/2003 | Braun et al. | 123/510 |
| 2004/0037713 | A1 | 2/2004 | Schelhas et al. | |
| 2004/0173188 | A1 * | 9/2004 | Braun | 123/509 |
| 2007/0227510 | A1 * | 10/2007 | Mason et al. | 123/514 |
| 2008/0127948 | A1 | 6/2008 | Braun et al. | |
| 2008/0190397 | A1 * | 8/2008 | Tipton et al. | 123/509 |
| 2008/0295593 | A1 * | 12/2008 | Yokoo | 73/305 |
| 2012/0199223 | A1 * | 8/2012 | Beyer et al. | 137/565.01 |
| 2013/0098339 | A1 * | 4/2013 | Yoon et al. | 123/495 |

FOREIGN PATENT DOCUMENTS

| | | |
|---|---|---|
| DE | 102010041577 | 3/2012 |
| WO | 0003137 | 1/2000 |
| WO | 2008049900 | 5/2008 |

OTHER PUBLICATIONS

English Translation of Office action for Chinese Application No. 201380032944.0 dated Jul. 21, 2016, 7 pages.

* cited by examiner

FUEL SUPPLY SYSTEM

CROSS-REFERENCE TO RELATED APPLICATIONS

The present application claims priority to U.S. Provisional Patent Application No. 61/650,254, filed May 22, 2012, the entire contents of which are hereby incorporated by reference.

BACKGROUND

The present invention relates to fuel supply systems. Fuel supply systems (sometimes called "fuel pump modules" typically include a pump unit and a filter unit and are located inside a fuel tank in a vehicle or other device. The pump unit pumps fuel from the tank through the filter unit and out through a supply outlet to a fuel burning device, such as an internal combustion engine. A check valve at the outlet of the pump unit ensures one-way flow through the pump unit.

SUMMARY

In one aspect, the invention provides a fuel supply system including a fuel pump having a bottom inlet end configured to pick up fuel and a top discharge end configured to discharge fuel at a pressure higher than that of the inlet end. A housing defines a pressure vessel in fluid communication with the discharge end of the fuel pump. The fuel pump is secured with respect to the housing so that the pressure vessel is laterally adjacent the fuel pump and the pressure vessel and the fuel pump have overlapping heights. Exactly one check valve is positioned between the discharge end of the fuel pump and the pressure vessel, and the check valve is spaced laterally away from the discharge end of the fuel pump at an inlet to the pressure vessel.

In another aspect, the invention provides a fuel supply system including a fuel pump having a bottom inlet end configured to pick up fuel and a top discharge end configured to discharge fuel at a pressure higher than that of the inlet end. A housing defines a pressure vessel in fluid communication with the discharge end of the fuel pump. The fuel pump is secured in a receptacle area of the housing so that the pressure vessel is laterally adjacent the fuel pump and the pressure vessel and the fuel pump have overlapping heights. A channel is defined by the housing and is configured to receive 100 percent of the flow from the fuel pump. The channel terminates at a manifold feeding exactly two further flow paths, including a first flow path through a check valve and into the pressure vessel, and a second flow path through a jet pump configured to draw fuel from a remote location.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
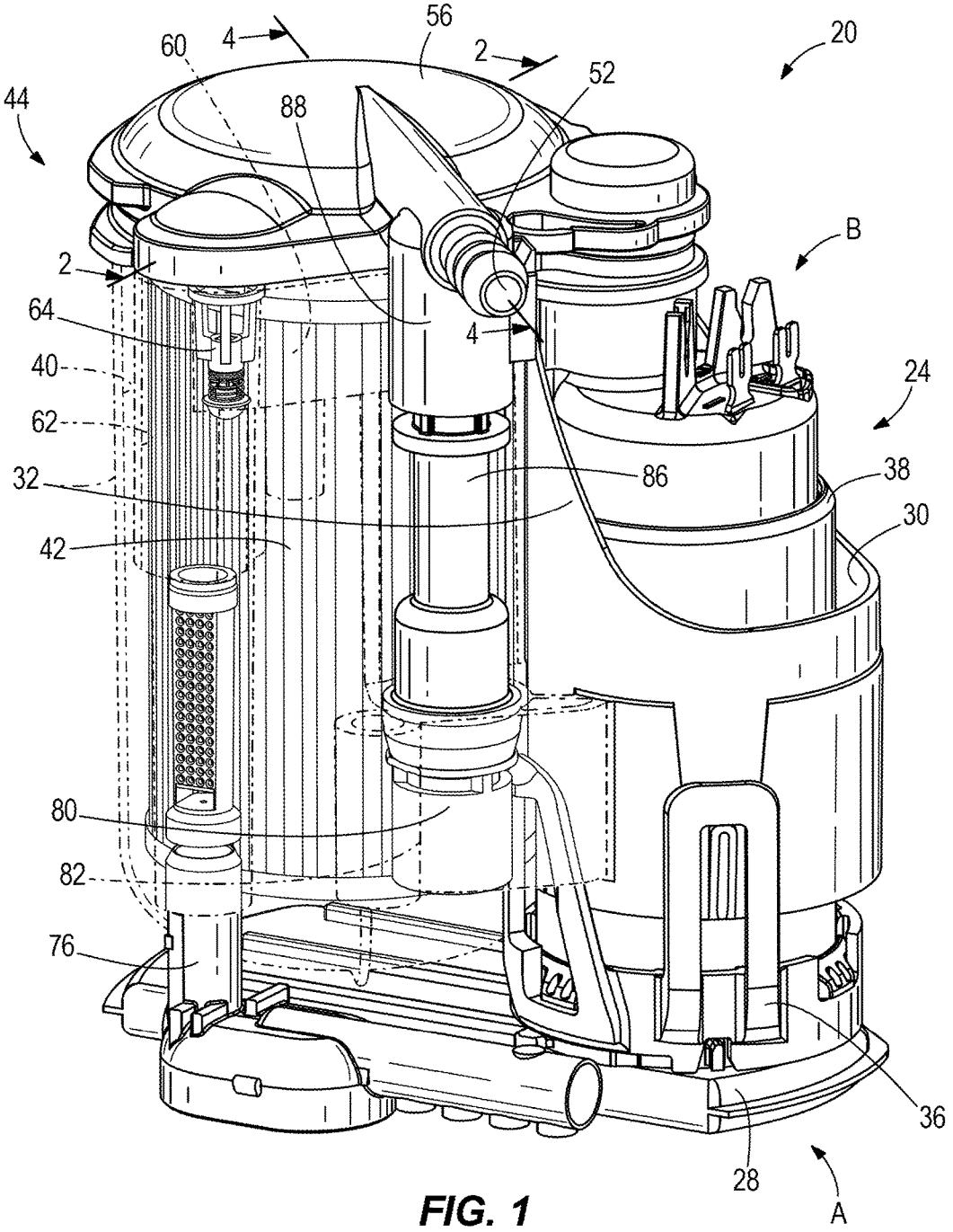
FIG. 1 is a perspective view of a fuel supply module according to one construction of the invention.

As shown in FIG. 1, a fuel supply module or fuel pump module 20 includes a fuel pump or "pump unit" 24 operable to pressurize liquid fuel when energized. The pump unit 24 has a first end A and a second end B, an axial direction or direction of elongation being defined therebetween. The first end A is configured to be a bottom end positioned vertically below the second end B, which is configured to be a top end. The pump module 20 can be positioned inside a fuel tank for supplying fuel to a fuel burning device, such as an internal combustion engine. The axial direction of the pump module 20 is oriented vertically within the tank, with a pump pickup and a coarse filter 28 at the bottom end A, and an axis of the pump unit 24 arranged upright or vertically. The pump unit 24 is positioned in a receptacle area 30 of a housing 32. The pump unit 24 can be insertable into the receptacle area 30 in the axial or vertical direction and can be retained with a clip 36 or other device. In other constructions, the pump unit 24 may be positioned relative to the housing 32 in other ways. Although positionally retained in relation to the housing 32, the pump unit 24 also includes a case or housing 38 of its own.

The housing 32 defines a pressure vessel 40 receiving the fuel pressurized by the pump unit 24. The pressure vessel 40 can constitute a majority portion of the housing 32. The pressure vessel 40 can be utilized for defining a volume directly surrounding a filter 42. Thus, the pressure vessel 40 can be part of a "filter unit" 44 positioned alongside the pump unit 24. Because the housing 32 defines both the pressure vessel 40 and the receptacle area 30 for the pump unit 24, the filter unit 44 and the pump unit 24 are commonly housed by a single shell or housing 32. As shown in the drawings, the pressure vessel 40 and the pump unit 24 are positioned side-by-side, having overlapping heights such that a horizontal plane (i.e., transverse to the axial direction defined by the pump unit 24 intersects both the pump unit 24 and the pressure vessel 40 at at least one height. As illustrated, a majority of the height of the pump unit 24 overlaps with a majority of the height of the pressure vessel 40. Fuel is pumped via the pump unit 24 through the pressure vessel 40 and out to the engine or other device via an outlet port 52 or primary supply outlet. The illustrated outlet port 52 is formed integrally as a single piece with a cover 56 located at an upper end of the pressure vessel 40.

Figure 2:
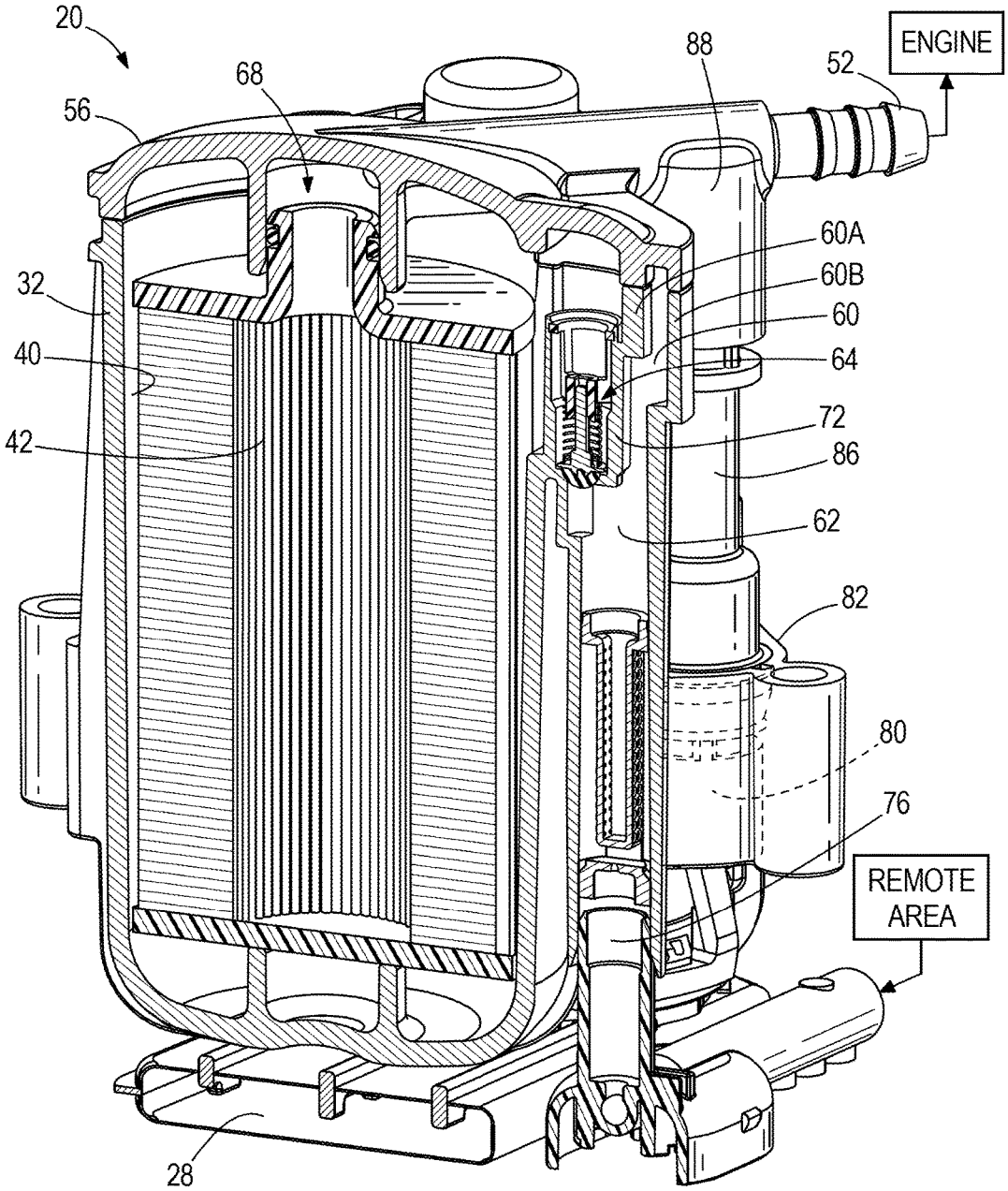
FIG. 2 is a cross-sectional view of the fuel supply module of FIG. 1.
Figure 3:
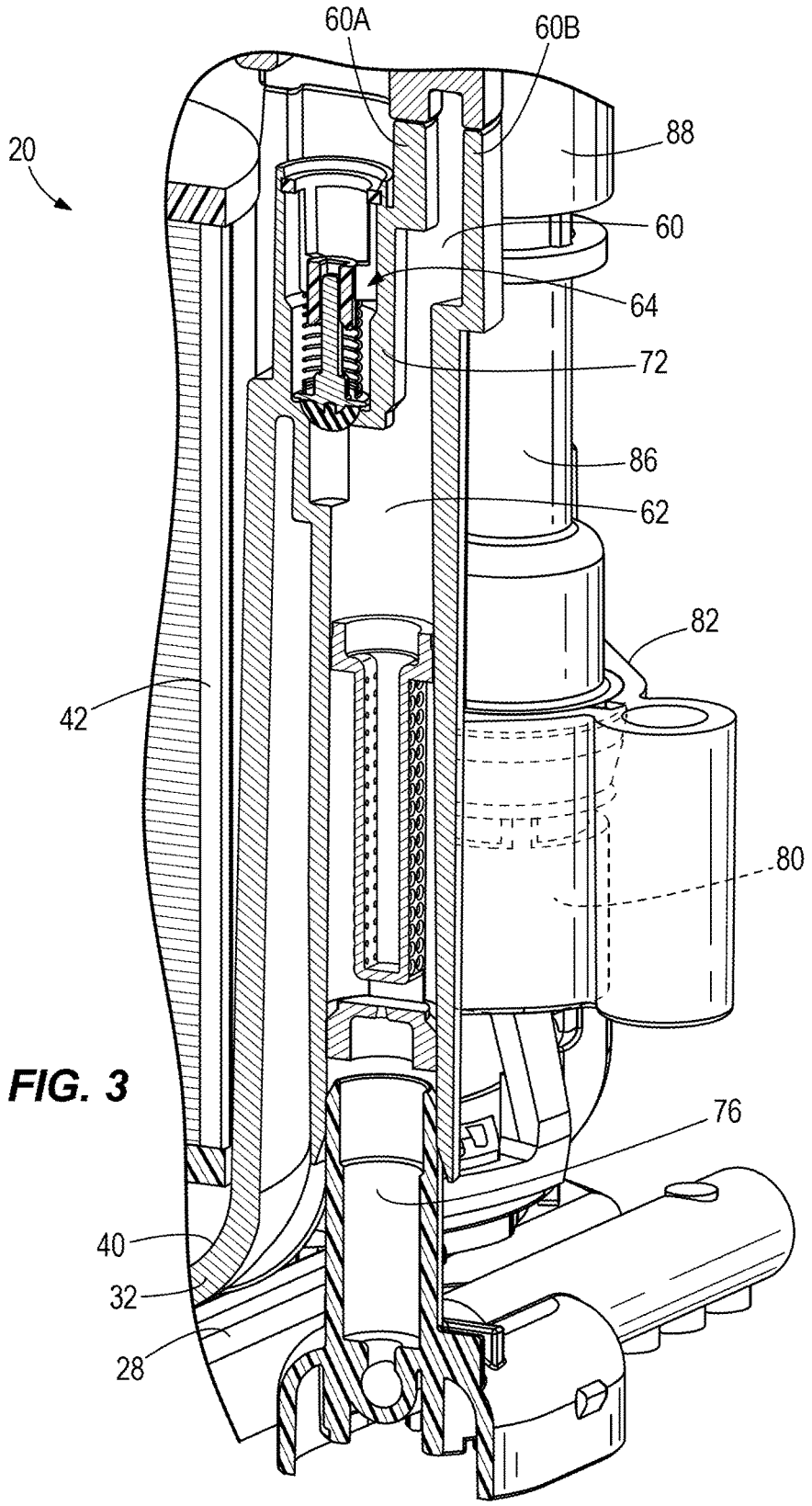
FIG. 3 is a detail cross-sectional view of the fuel supply module as shown in FIG. 2.

In order to minimize the axial height for better packaging in demanding applications, there is no check valve at the upper end B of the pump unit 24. Rather, fuel is sent from the pump unit 24 directly into a hydraulic channel 60 formed in the housing 32 as shown in FIGS. 2 and 3. In normal operation, 100 percent or all of the fuel pumped by the pump unit 24 enters the channel 60, and 0 percent or none of the fuel is first passed through a check valve. The channel 60 receiving the fuel from the pump unit 24 can be located substantially at a radially outward portion of the pressure vessel 40. The channel 60 can extend circumferentially around a portion of the housing 32 (e.g., about one-third or 120 degrees. As illustrated, the channel 60 is positioned at an upper edge of the housing 32 at an outer peripheral portion thereof, and the channel 60 has a rectangular cross-sectional shape. The channel 60 includes an interior wall 60A shared with the pressure vessel 40 and an exterior wall 60B spaced laterally from the interior wall 60A, and the exterior wall 60B is thinner than the interior wall 60A. The channel 60 terminates at a manifold 62, from which the fuel is directed through a check valve 64, into the pressure vessel 40, and through the filter 42 (e.g., radially inward to a filter outlet 68 and the outlet port 52 of the pump module 20. The check valve 64 can have a receptacle or housing portion 72 that is integrally formed as a single piece with the housing 32 as shown, or constructed as a separate piece as a drop-in component into the housing 32. The housing portion 72 can have a shared wall with the pressure vessel 40 as shown in FIGS. 2 and 3. The check valve 64 allows flow from the pump unit 24 into the pressure vessel 40 and prevents flow in the reverse direction. In the illustrated construction, the flow through the check valve 64 is vertically upward.

From the manifold 62, without first being directed through the check valve 64, or any check valve whatsoever, a portion of the flow from the pump unit 24 can also drive a jet pump 76 to draw fuel toward the immediate area of the pump module 20 from a remote tank area. Thus, any portion of the pumped fuel not directed through the check valve 64 to the pressure vessel 40 is directed through the jet pump 76, and vice versa.

Figure 4:
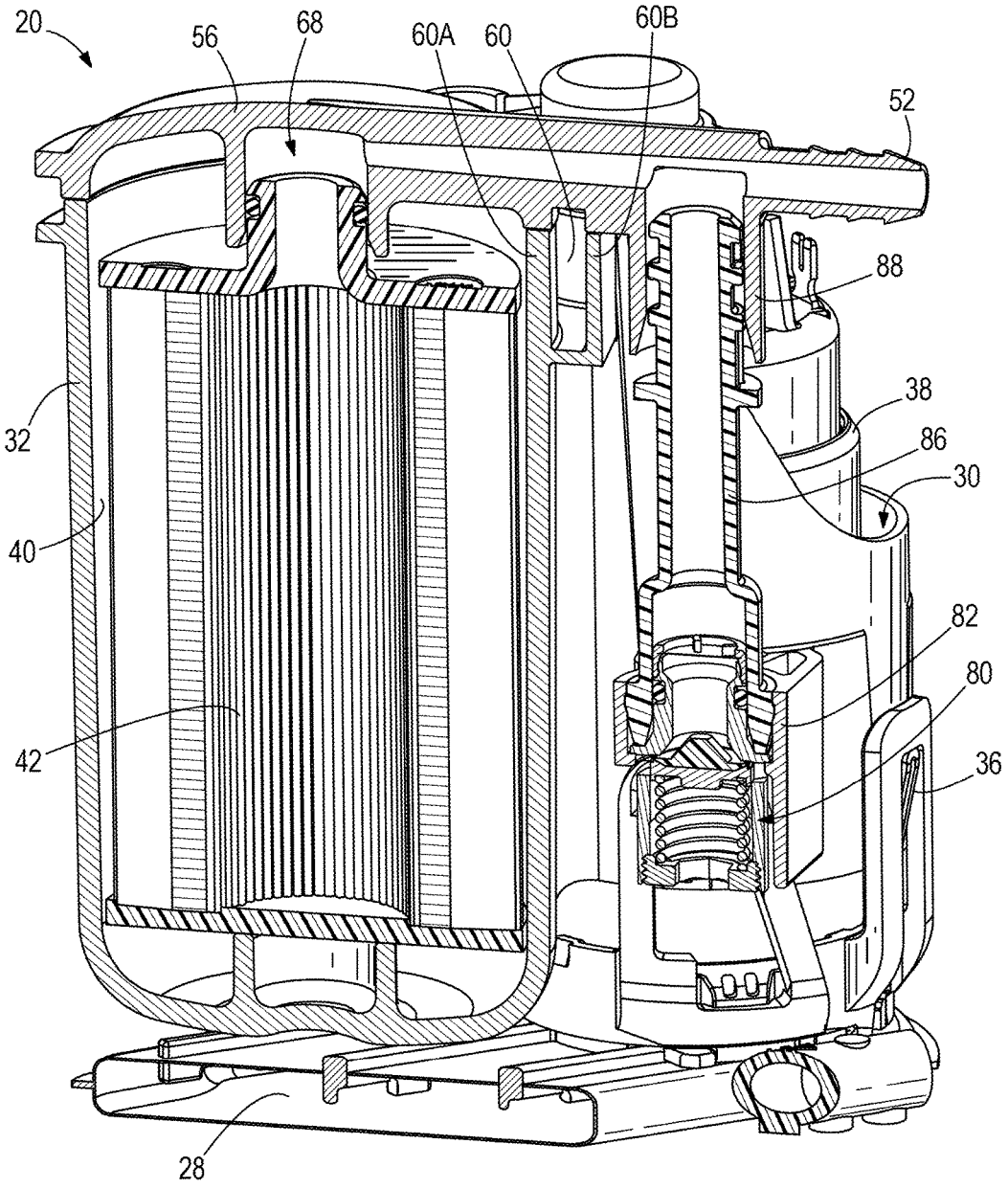
FIG. 4 is another cross-sectional view of the fuel supply module of FIG. 1.

Pressure regulation/relief is achieved with a pressure regulation valve 80 located in communication with an outlet passage positioned between the pressure vessel 40 and the outlet port 52. The housing 32 includes a receptacle 82 integrally formed as a single piece therewith and configured to receive the pressure regulation valve 80. The pressure regulation valve 80 is fluidly coupled with the outlet port 52 via a connection pipe 86, which is coupled between the regulator receptacle 82 at a lower end and a receptacle port 88 of the outlet passage adjacent the outlet port 52 at an upper end as shown in FIG. 4. Along with the outlet passage, the upper receptacle port 88 can be formed integrally as a single piece with the cover 56 such that the connection pipe 86 is installed into place simultaneously as the cover 56 is assembled with the housing 32. As shown in FIG. 4, the cover 56 can also at least partially define the channel 60 between the pump unit 24 and the check valve 64 so that the channel 60 is defined simultaneously as the cover 56 is assembled with the housing 32. The assembly may be a hot plate weld process.

The pump module 20 as described above enables a lower overall height compared to conventional pump modules. This can be particularly advantageous as the increase of technical content on new vehicles (hybridization and electrification places greater packaging demands on a vehicle's fuel tank, typically resulting in less available tank height than previous applications. Historically, achieving a low set up height requires the fuel pump to be oriented horizontally rather than vertically. This has obvious height advantages, however it complicates the assembly process as the fuel pump module becomes longer than the tank opening and a complicated method must be used to guide the module through the tank opening. The pump module 20 allows simple vertical installation, while still reducing the set up height by 20 percent.

What is claimed is:

1. A fuel supply system comprising:

a fuel pump having a bottom inlet end configured to pick up fuel and a top discharge end configured to discharge fuel at a pressure higher than that of the inlet end;

a housing defining a pressure vessel in fluid communication with the top discharge end of the fuel pump, the fuel pump being secured with respect to the housing so that the pressure vessel is laterally adjacent the fuel pump and the pressure vessel and the fuel pump have overlapping heights;

exactly one check valve positioned between the top discharge end of the fuel pump and the pressure vessel; and a channel located within the housing alongside the pressure vessel between the top discharge end of the fuel pump and the check valve, the channel being configured to receive all of the flow discharged from the fuel pump, the channel terminating at a manifold providing a two-way diversion of the flow of fuel between a first portion provided through the check valve and into the pressure vessel, and a second portion provided to a jet pump, wherein the channel extends along an outer peripheral portion of the housing such that the check valve is positioned at an inlet to the pressure vessel at a circumferentially-distant location spaced apart from the discharge end of the fuel pump in a direction about the outer peripheral portion of the housing.

2. The fuel supply system of claim 1, wherein the channel is positioned at an upper edge of the housing, and the channel has a rectangular cross-sectional shape.

3. The fuel supply system of claim 1, wherein the channel includes an interior wall shared with the pressure vessel and an exterior wall spaced laterally from the interior wall, and the exterior wall is thinner than the interior wall.

4. The fuel supply system of claim 1, wherein the channel is defined in part by the housing and defined in part by a cover secured to the housing, the cover enclosing an upper portion of the pressure vessel.

5. The fuel supply system of claim 1, further comprising a filter positioned within the pressure vessel.

6. The fuel supply system of claim 5, wherein the filter is a fine filter, the fuel supply system further comprising a coarse filter positioned adjacent the inlet end of the fuel pump.

7. The fuel supply system of claim 1, further comprising a cover defining an upper portion of the pressure vessel and including an outlet port in fluid communication with the pressure vessel;

a receptacle formed in a lower portion of the housing;

a pressure regulation valve positioned in the receptacle; and a connection tube having a lower end coupled with the receptacle and an upper end coupled with the cover adjacent the outlet port.

8. The fuel supply system of claim 7, wherein the cover is hot plate welded to the housing.

9. The fuel supply system of claim 1, wherein the housing includes a receptacle area adjacent the pressure vessel and the fuel pump is secured in the receptacle area.

10. A fuel supply system comprising:

a fuel pump having a bottom inlet end configured to pick up fuel and a top discharge end configured to discharge fuel at a pressure higher than that of the inlet end;

a housing defining a pressure vessel in fluid communication with the top discharge end of the fuel pump, the fuel pump being secured in a receptacle area of the housing so that the pressure vessel is laterally adjacent the fuel pump and the pressure vessel and the fuel pump have overlapping heights; and a channel defined by the housing and configured to receive 100 percent of the flow from the fuel pump, the channel terminating at a manifold feeding exactly two further flow paths, including a first flow path through a check valve and into the pressure vessel, and a second flow path through a jet pump configured to draw fuel from a remote location, wherein the channel extends along an outer peripheral portion of the housing such that the check valve is positioned at an inlet to the pressure vessel at a circumferentially-distant location spaced apart from the top discharge end of the fuel pump in a direction about the outer peripheral portion of the housing.

11. The fuel supply system of claim 10, wherein the check valve is the only check valve positioned between the top discharge end of the fuel pump and the pressure vessel.

12. The fuel supply system of claim 10, further comprising a filter positioned within the pressure vessel.

13. The fuel supply system of claim 12, wherein the filter is a fine filter, the fuel supply system further comprising a coarse filter positioned adjacent the inlet end of the fuel pump.

14. The fuel supply system of claim 10, wherein the channel is positioned at an upper edge of the housing, and the channel has a rectangular cross-sectional shape.

15. The fuel supply system of claim 10, wherein the channel includes an interior wall shared with the pressure vessel and an exterior wall spaced laterally from the interior wall, and the exterior wall is thinner than the interior wall.

16. The fuel supply system of claim 10, wherein the channel is defined in part by the housing and defined in part by a cover secured to the housing, the cover enclosing an upper portion of the pressure vessel.

17. The fuel supply system of claim 10, further comprising a cover defining an upper portion of the pressure vessel and including an outlet port in fluid communication with the pressure vessel;

a receptacle formed in a lower portion of the housing;

a pressure regulation valve positioned in the receptacle; and a connection tube having a lower end coupled with the receptacle and an upper end coupled with the cover adjacent the outlet port.

18. The fuel supply system of claim 17, wherein the cover is hot plate welded to the housing.

* * * * *